US010631646B1

(12) United States Patent
Zaifman

(10) Patent No.: US 10,631,646 B1
(45) **Date of Patent: *Apr. 28, 2020**

(54) FOLDABLE CHAIR AND FOLDABLE TABLE

(71) Applicant: Yosef Zaifman, Yavne (IL)

(72) Inventor: Yosef Zaifman, Yavne (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/690,704

(22) Filed: Nov. 21, 2019

Related U.S. Application Data

(63) Continuation of application No. 16/515,064, filed on Jul. 18, 2019, which is a continuation of application No. PCT/IB2019/053238, filed on Apr. 18, 2019.

(60) Provisional application No. 62/670,807, filed on May 13, 2018.

(51) Int. Cl.

| | |
|---|---|
| ***A47C 4/04*** | (2006.01) |
| ***A47B 13/02*** | (2006.01) |
| ***A47B 13/08*** | (2006.01) |
| ***A47C 7/00*** | (2006.01) |
| ***A47B 3/00*** | (2006.01) |
| ***A47B 3/14*** | (2006.01) |

(52) U.S. Cl.
CPC ..... *A47C 4/04* (2013.01); *A47B 3/002* (2013.01); *A47B 3/14* (2013.01); *A47B 13/023* (2013.01); *A47B 13/081* (2013.01); *A47C 7/004* (2013.01); *A47B 2003/008* (2013.01)

(58) Field of Classification Search
CPC ..... A47B 3/14; A47B 13/023; A47B 13/081; A47B 3/00; A47B 3/002; A47C 4/04
See application file for complete search history.

(56) References Cited

U.S. PATENT DOCUMENTS

| | | | | |
|---|---|---|---|---|
| 3,715,996 | A * | 2/1973 | Rolfshus | A47B 3/10 297/311 |
| 6,467,843 | B1 * | 10/2002 | Rossborough | A47C 3/34 108/150 |
| D873,042 | S * | 1/2020 | Dai | D6/353 |
| 2010/0001557 | A1 * | 1/2010 | Valaei Khiabani | A47B 3/00 297/141 |
| 2020/0015592 | A1 * | 1/2020 | Zaifman | A47C 4/04 |

* cited by examiner

*Primary Examiner* — Shin H Kim
(74) *Attorney, Agent, or Firm* — Mark M. Friedman

(57) ABSTRACT

A foldable chair, comprising a seat portion and a telescopic side wall includes rings of varying diameters consecutively arranged. A topmost ring is mounted to a bottom surface of the seat portion and has a smallest diameter. A bottommost ring has a largest diameter. In deployed position, the telescopic side wall is opened or partially folded to set and lock a desired height of the chair. In fully retracted position all of the rings are disposed adjacent the bottom surface of the seat portion. Each ring is an integral unit configured with a locking arrangement that selectively locks it to an adjacent ring. In some embodiments, a security lock centrally disposed along a height of the chair substantially perpendicular to the varying diameters of the rings secures the locking arrangement. A table uses the foldable chair as a leg and can store several, for example four, foldable chairs.

9 Claims, 20 Drawing Sheets

Perspective View

Side View

Top View

Front View

FOLDABLE CHAIR AND FOLDABLE TABLE

FIELD AND BACKGROUND OF THE INVENTION

The present invention is in the field of foldable chairs and foldable tables.

SUMMARY OF THE INVENTION

One aspect of the present invention is a foldable chair, comprising a seat portion; a telescopic side wall extending downwardly from the seat portion, the telescopic side wall including a plurality of rings of varying diameters and consecutively arranged such that a topmost ring is mounted to a bottom surface of the seat portion and has a smallest diameter and a bottommost ring has a largest diameter, the telescopic side wall configured to have a deployed position that is completely opened or partially folded such that a desired height of the chair is set and locked, and a retracted position such that in a fully retracted position all of the rings are disposed adjacent the bottom surface of the seat portion, wherein each of the rings is an integral unit configured with a locking arrangement that selectively locks each ring with respect to an adjacent ring; and a security lock centrally disposed along a height of the foldable chair substantially perpendicular to the varying diameters of the rings, the security lock configured to secure the locking arrangement.

A further aspect of the invention is a foldable table having a deployed table position and having a table storage position, comprising: (A) a leg portion comprising a foldable chair either positioned centrally as a leg or positioned peripherally for storage, the leg position comprising a seat portion; a telescopic side wall extending downwardly from the seat portion, the telescopic side wall including a plurality of rings of varying diameters and consecutively arranged such that a topmost ring is mounted to a bottom surface of the seat portion and has a smallest diameter and a bottommost ring has a largest diameter, the telescopic side wall configured to have a deployed position that is completely opened or partially folded such that a desired height of the chair is set and locked, and a retracted position such that in a fully retracted position all of the rings are disposed adjacent the bottom surface of the seat portion, wherein each of the rings is an integral unit having a height and configured with a locking arrangement that selectively locks each ring with respect to an adjacent ring; and a security lock centrally disposed along a height of the foldable chair substantially perpendicular to the varying diameters of the rings, the security lock configured to secure the locking arrangement; and (B) a table portion foldable on itself into two segments and having an underside with at least one central pin for receiving in the deployed table position the seat portion of the foldable chair in the deployed position of the foldable chair.

These and other features, aspects and advantages of the present invention will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

Figure 1:
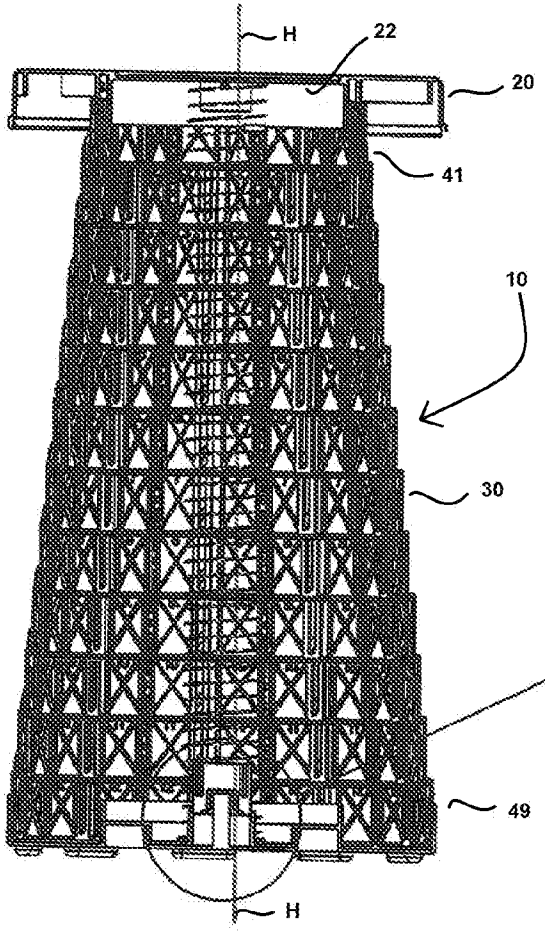
FIG. 1 is a front view of a foldable chair in a deployed position, in accordance with one embodiment of the invention.
Figure 2:
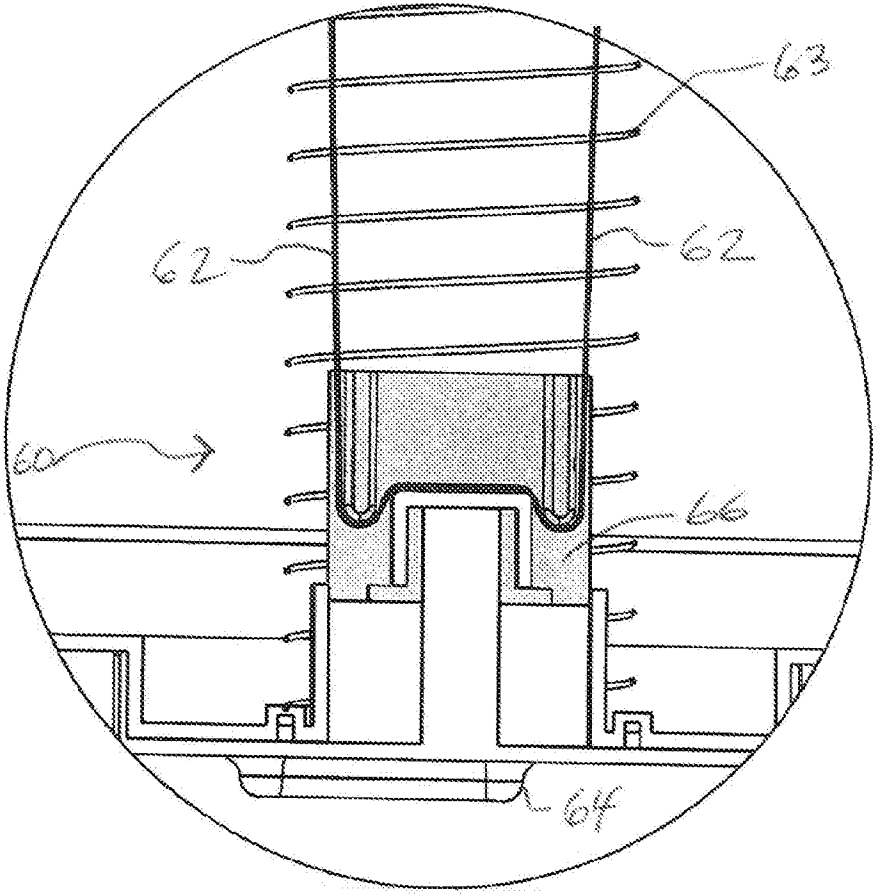
FIG. 2 is an enlarged view of an encircled section of FIG. 1 showing a security lock, in accordance with one embodiment of the invention.
Figure 4:
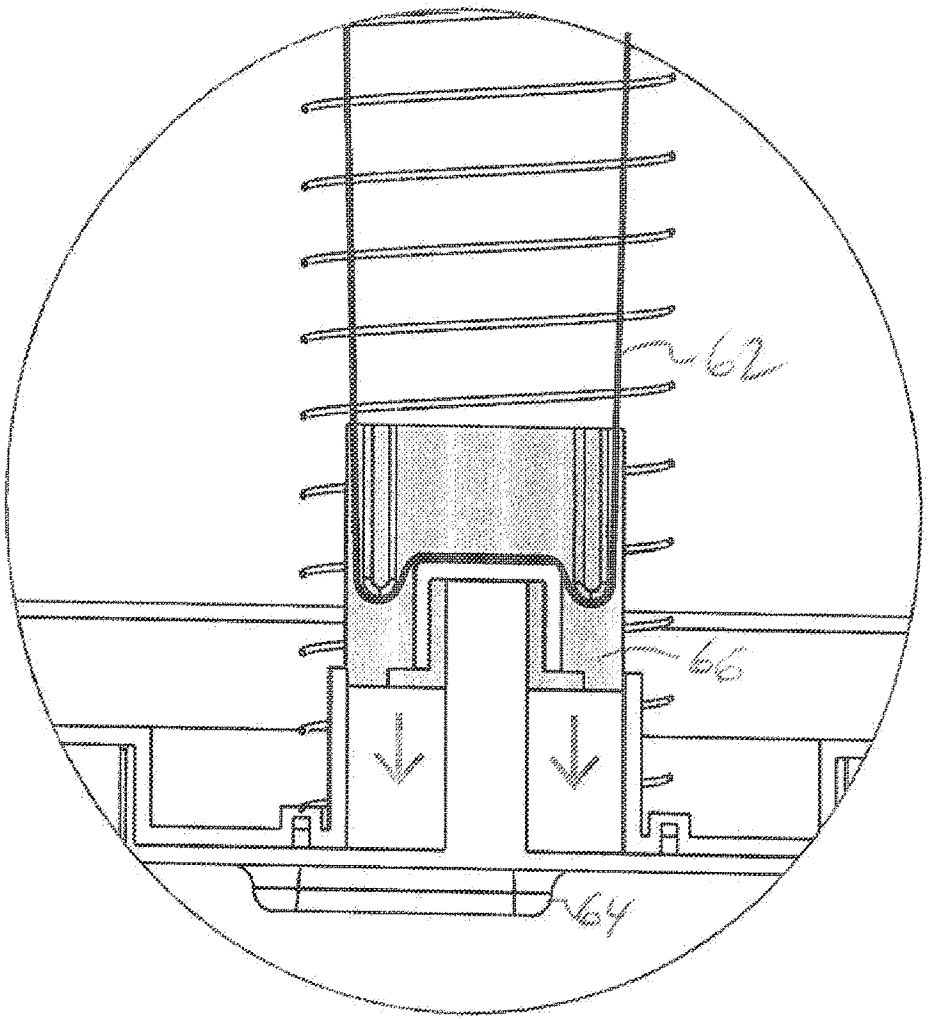
FIG. 4 is an enlarged view of an encircled section of FIG. 3 showing a security lock released, in accordance with one embodiment of the invention.
Figure 3:
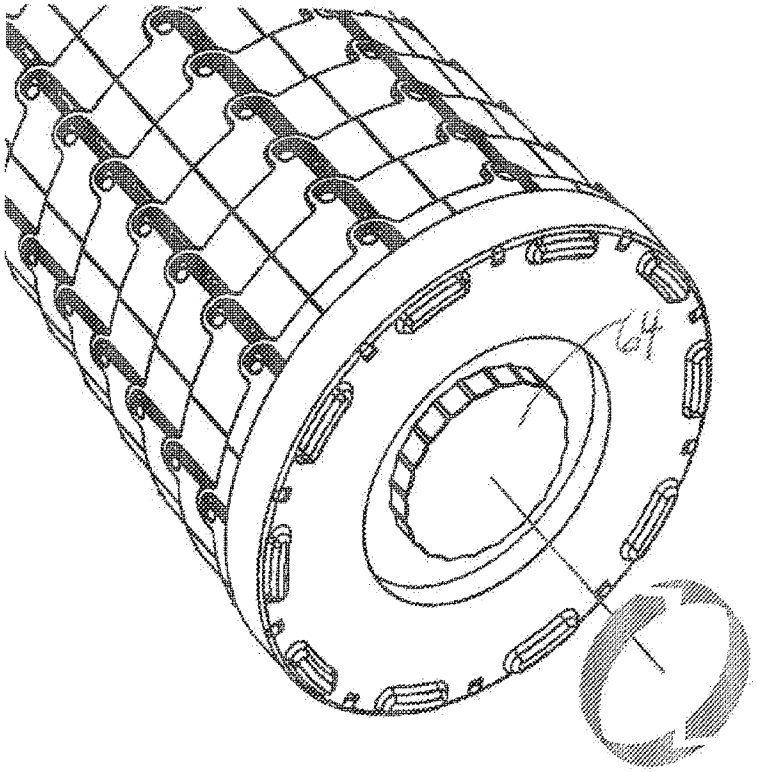
FIG. 3 is an end and side view of a foldable chair in a deployed position showing an accessible actuator of the security lock, in accordance with one embodiment of the invention.
Figure 6:
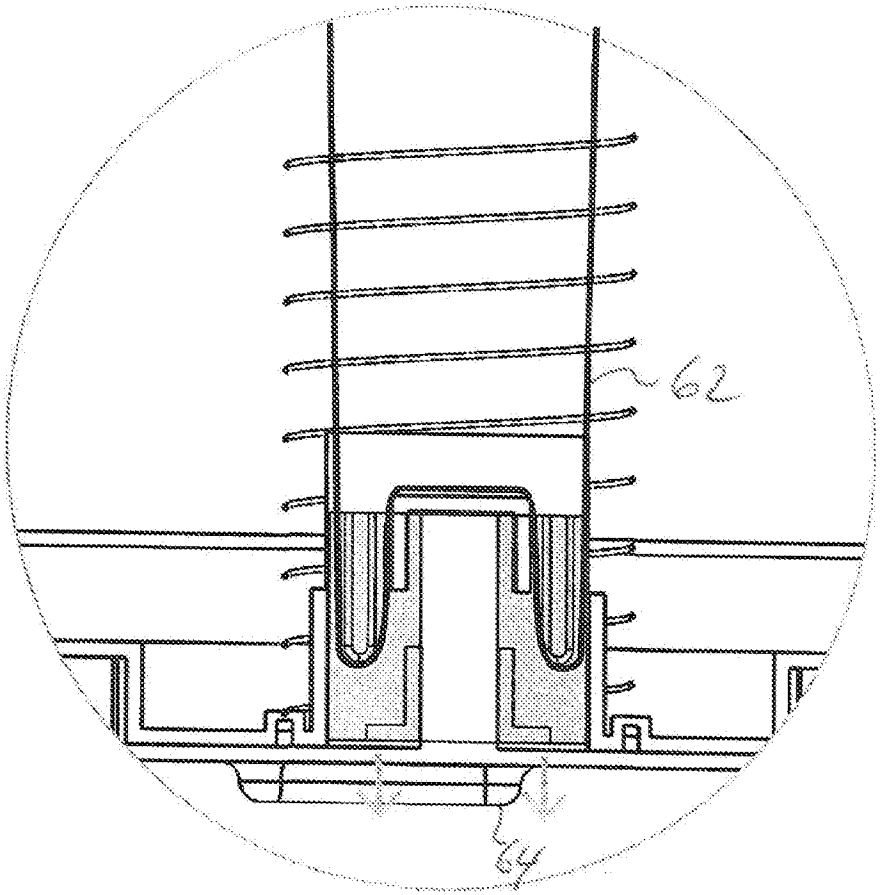
FIG. 6 is an enlarged view of an encircled section of FIG. 5 showing the security lock in locked position, in accordance with one embodiment of the invention.
Figure 5:
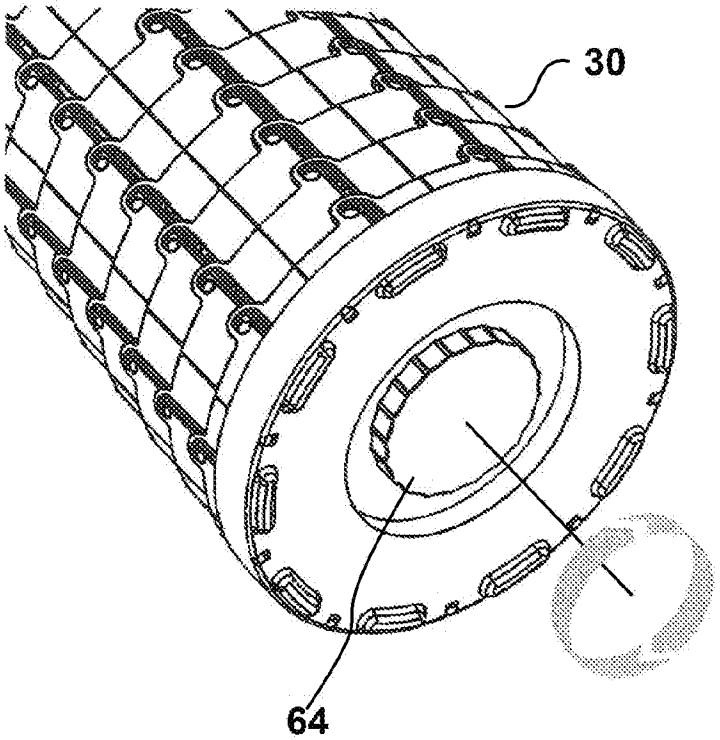
FIG. 5 is an end and side view of a foldable chair in a deployed position, in accordance with one embodiment of the invention.
Figure 7B:
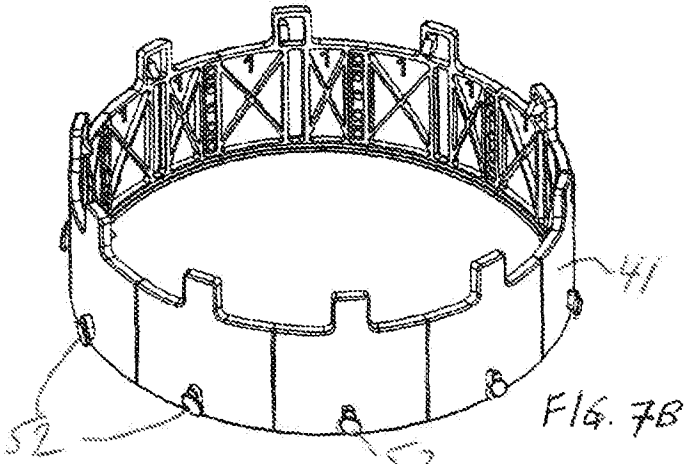
FIG. 7B is a perspective view of a topmost ring of a foldable chair, in accordance with one embodiment of the invention.
Figure 7D:
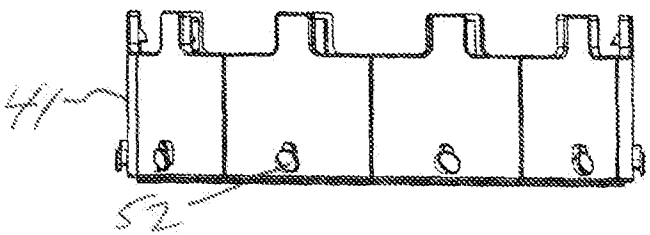
FIG. 7D is a side view of a topmost ring of a foldable chair, in accordance with one embodiment of the invention.
Figure 7A:
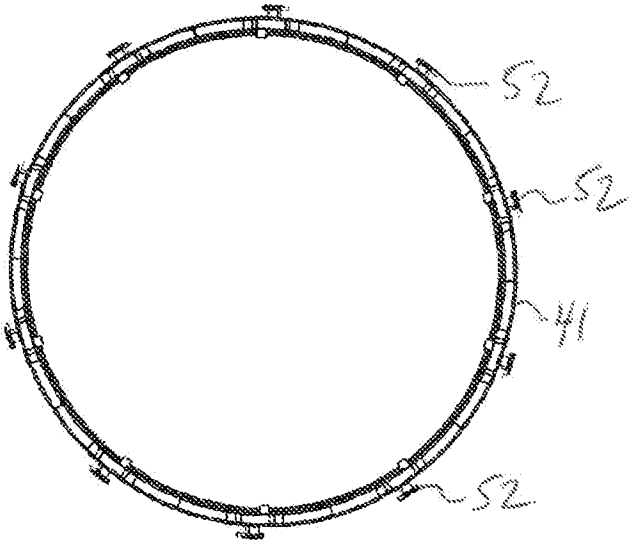
FIG. 7A is a top view of a topmost ring of a foldable chair, in accordance with one embodiment of the invention.
Figure 7C:
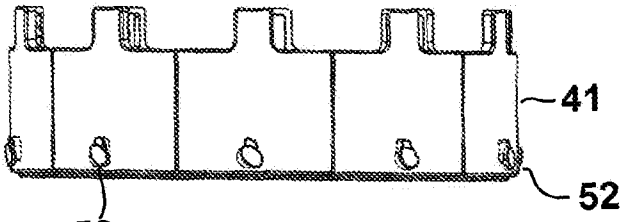
FIG. 7C is a front view of a topmost ring of a foldable chair, in accordance with one embodiment of the invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The invention generally provides a foldable chair and in some embodiments a foldable table configured to either use the chair as a leg when the chair is in its deployed position or to store up to four foldable chairs in their retracted position. In certain embodiments of the foldable chair, each foldable chair includes a seat portion and a telescopic side wall extending downwardly from the seat portion. The telescopic side wall may be configured with a deployed position and a retracted position. In the deployed position the telescopic side wall may be configured to be completely opened such or partially folded such that the desired height of the chair can be set. The side wall may include a plurality of rings each having varying diameters and consecutively arranged such that the topmost rings, which is mounted to the bottom surface of the seat portion, has the smallest diameter while the bottom most member has the largest diameter. In this way, in the retracted position the rings can be consecutively disposed inside one another. For example in the fully retracted position all the rings are disposed adjacent the bottom surface of the chair portion. In some embodiments, the rings are provided with a locking arrangement configured to selectively lock each ring with respect to adjacent rings. This way, in the deployed position the rings are locked with respect to one another thus consecutively extending, while in the retracted position the rings are unlocked, thus can be folded towards the bottom surface of the seat portion of the chair.

According to a non-limiting example, the locking arrangement includes at least one pin provided on each of the rings and a corresponding groove on an adjacent ring. The groove extends along the height of the ring and includes an arched segment. The pin is configured to slide along the groove and in and out of the arched segment. When the pin is disposed in the arched segments the pin locks the two adjacent rings to one another, rotation of the ring sidewardly with respect to the adjacent ring causes the pin to slide out of the arched segment and unlocks the ring. Further sliding the pin along the groove causes the ring to fold. Each pin can be provided with a top portion configured for snap-coupling, such that the pin is maintained in the arched segment.

In some embodiments, the chair is provided with an actuating mechanism for rotating the rings with respect to one another. For example, the actuating mechanism can include a rotation disk on the bottom surface of the seat portion coupled to the topmost ring. Rotation of the rotation disk causes the rotation of the ring and allows locking or unlocking thereof.

According to one example, each of the rings is an integral unit. In one non-limiting implementation of the ring, the integral unit of the ring has integrally connected segments, wherein each segment may be provided with a groove for coupling to a corresponding pin of an adjacent ring.

The invention further provides a folding table having a foldable table portion with one of the foldable chairs mounted thereto as a leg for the table. The table portion includes two segments configured to be folded one on the other using hinges such that a delimited area is formed therebetween. The delimited area is configured with a pair of pins to accommodate a foldable chair in a retracted position of the foldable chair and to hold up to four such chairs in stored position.

The folding table can further include a locking arrangement for locking the leg of the table—which is the foldable chair in retracted position—to the table portion and to hold the stored chair(s) to the table portion in a stored position.

The principles and operation of a foldable chair may be better understood with reference to the drawings and the accompanying description.

As seen from FIGS. 1-11D, in one embodiment, the invention is a foldable chair 10, comprising a seat portion 20 and a telescopic side wall 30 extending downwardly from seat portion 20. Telescopic side wall 30 includes a plurality of rings 40 of varying diameters that may be consecutively arranged such that a topmost ring 41 is mounted to a bottom surface 22 of seat portion 20 and has a smallest diameter and a bottommost ring 49 has a largest diameter. In one non-limited option, seat portion 20 can be cushioned or padded.

Telescopic side wall 30 is configured to have a deployed position (see FIG. 1 and FIG. 10) that is completely opened or partially folded such that a desired height of the chair 10 is set and locked, and a retracted position (see FIG. 9) such that in a fully retracted position all of the rings 40 are disposed adjacent the bottom surface of the seat portion 20, wherein each of the rings 40 is an integral unit configured with a locking arrangement 50 that selectively locks each ring 40 with respect to an adjacent ring 40.

As seen from FIG. 1, typically, seat portion 20 has a larger diameter than the diameter of the topmost ring 41 in order to accommodate a person in seated position.

Chair 10 may also comprise a security lock 60 centrally disposed along a height, H, of the foldable chair 10 substantially perpendicular to the varying diameters of the rings 40, the security lock 60 configured to secure the locking arrangement 50.

In some embodiments, the security lock 60 comprises a flexible cable 62 centrally disposed within a spring 63 through the height of (in some embodiments substantially throughout the height of) the foldable chair 10 and connecting the seat portion 20 with the bottommost ring 49 in both the deployed and retracted positions, the bottommost ring 49 having an actuator 64 accessible to a user, wherein a coupler 66 couples the actuator 64 to the cable 62 so that a user who actuates the actuator 64 releases the security lock 60 by releasing pressure on the flexible cable 62. The height of chair 10 refers to the direction running from the seat portion 20 to the bottommost ring 49 substantially perpendicular to the diameters of rings 40. In certain embodiments, a top portion of cable 62 is connected to seat portion 20. In certain embodiments, cable 62 is a loop, in some cases a closed loop. In one embodiment, cable 62 is elastic in the sense that it returns to its original shape after forces on it are removed.

Figure 11A:
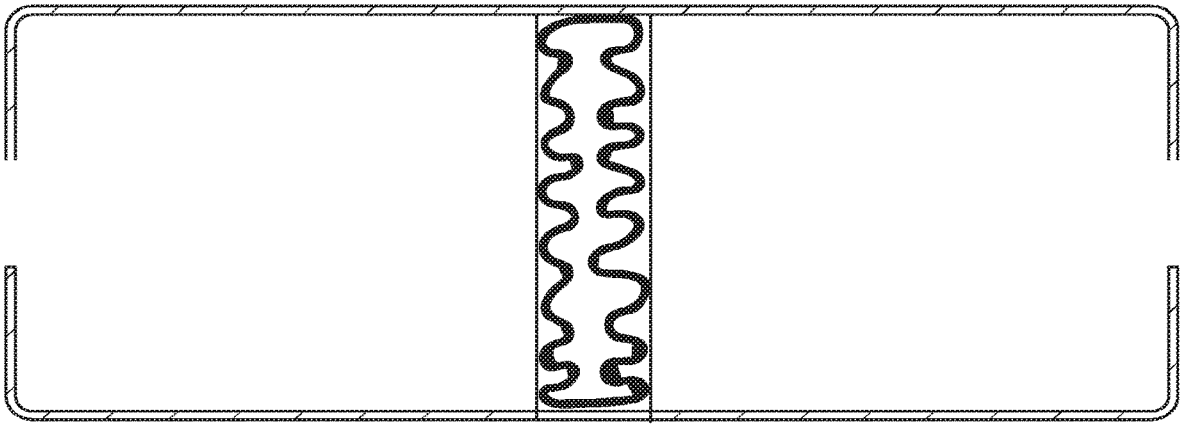
FIG. 11A shows the cable in retracted position of chair, in accordance with one embodiment of the invention.
Figure 11B:
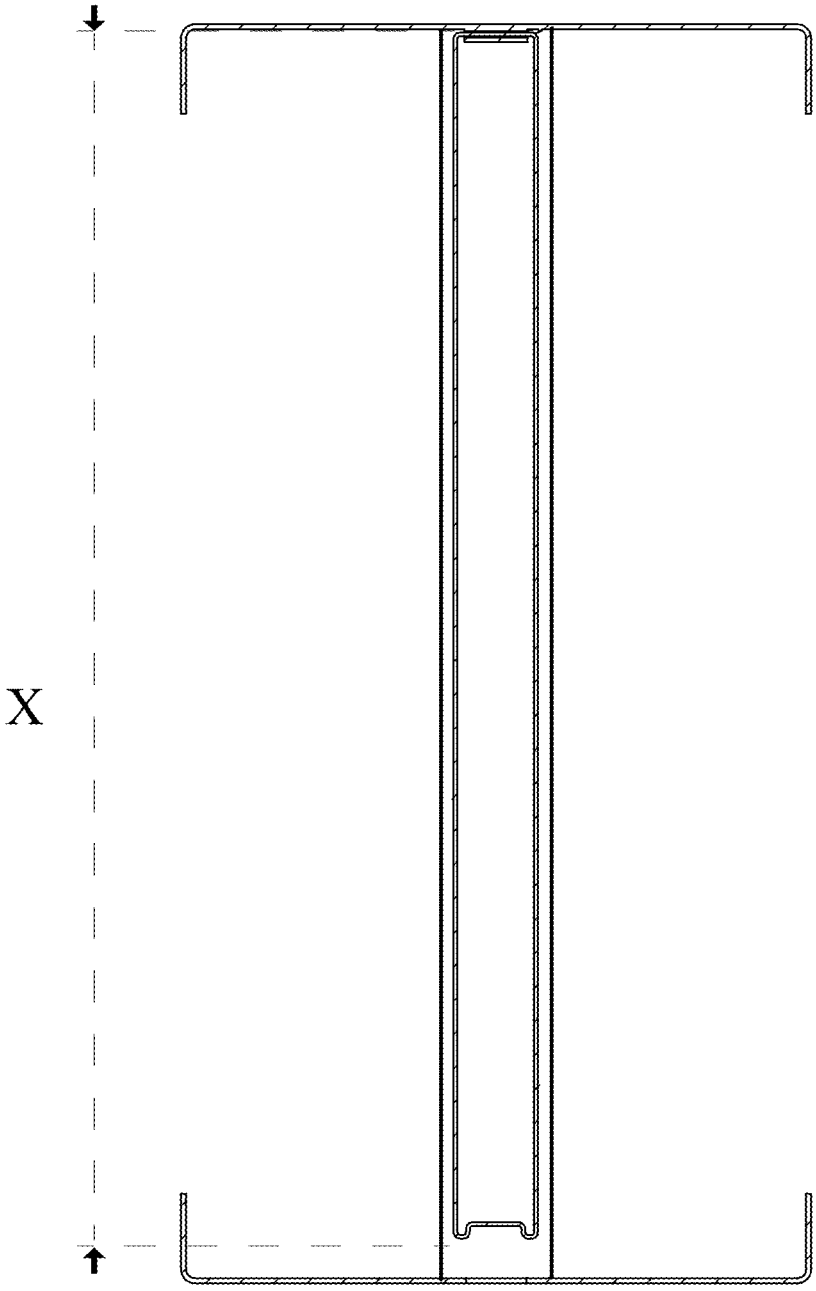
FIG. 11B shows the cable after pressure is placed on its lower part by a coupler coupled to an actuator, in accordance with one embodiment of the invention.
Figure 11C:
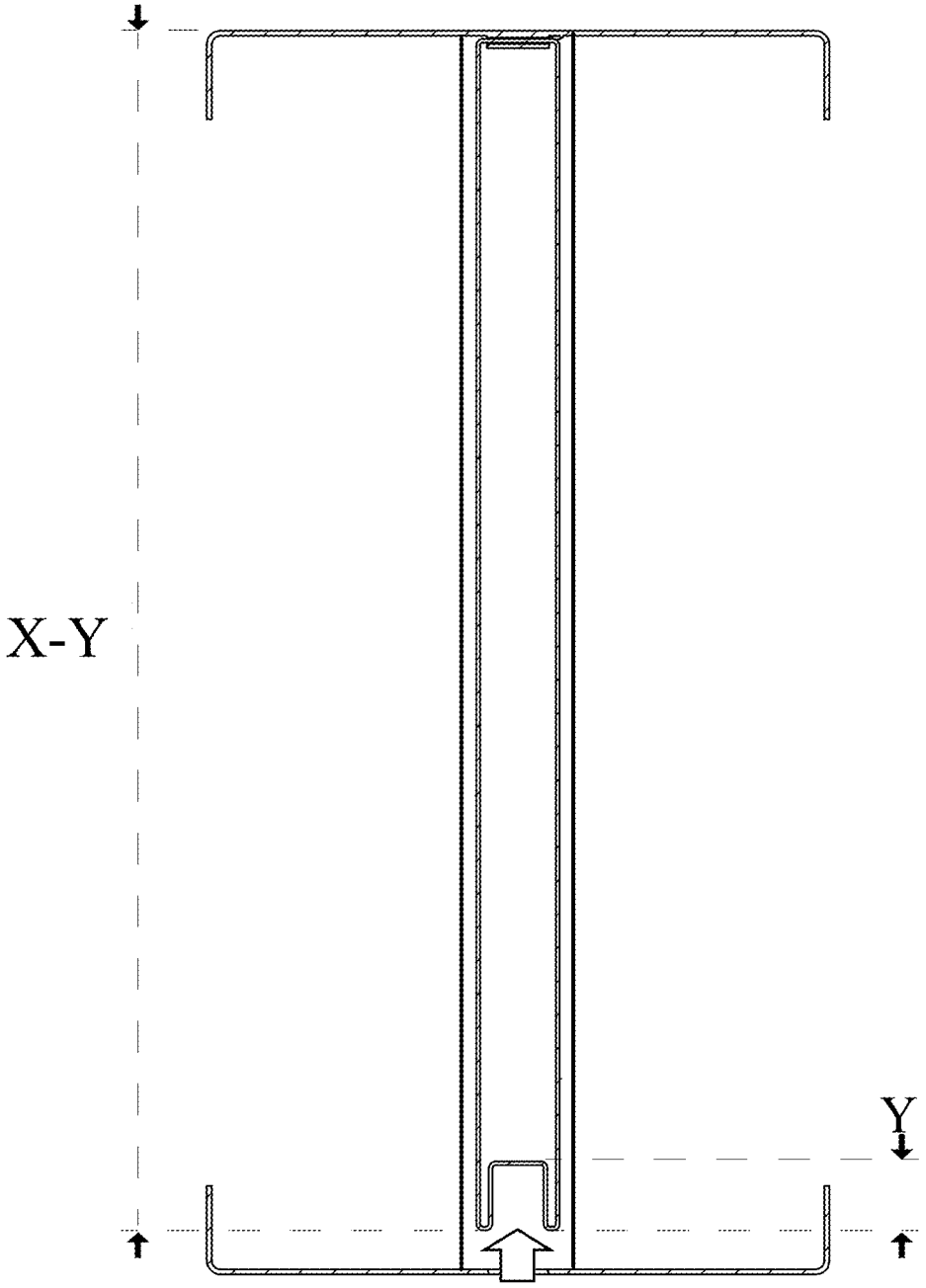
FIG. 11C shows the cable after further pressure is applied, in accordance with one embodiment of the invention.

FIGS. 11B-11C show one embodiment in which actuator 64 utilizes a coupler 66 to indent a central portion of cable 62 to increase pressure on cable 62 to activate security lock 60. Reverse rotation unlocks security lock 60.

Figure 11D:
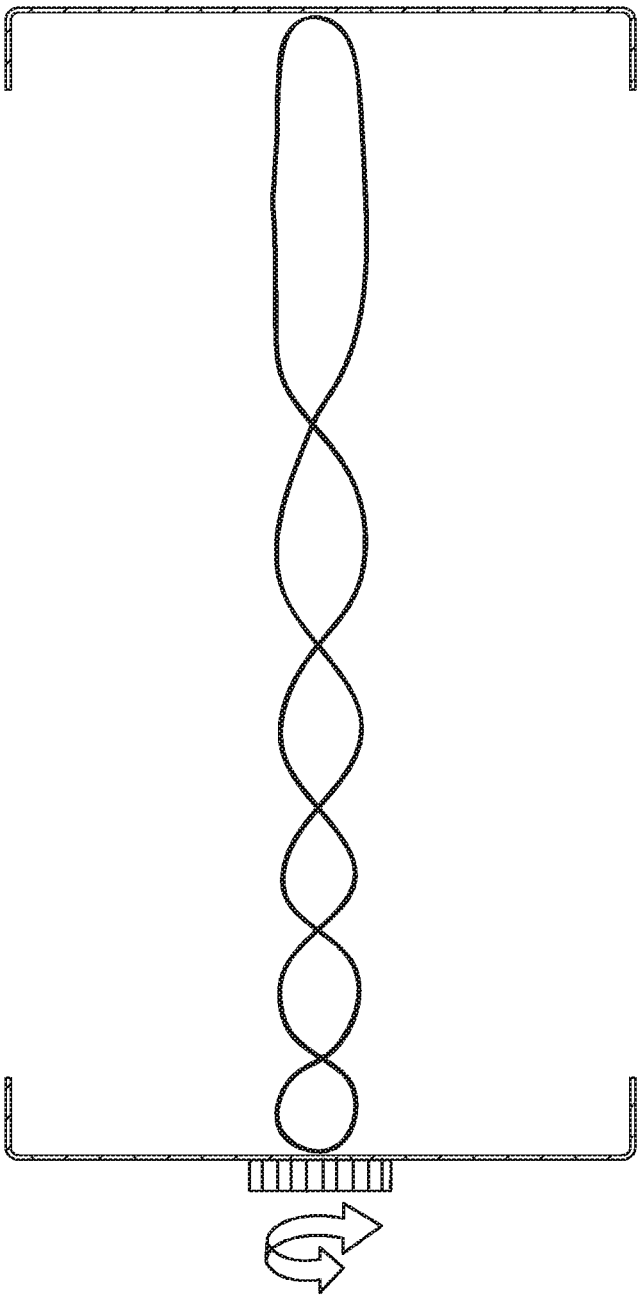
FIG. 11D shows the cable twisted by an actuator, in accordance with a further embodiment of the invention.
Figure 12B:
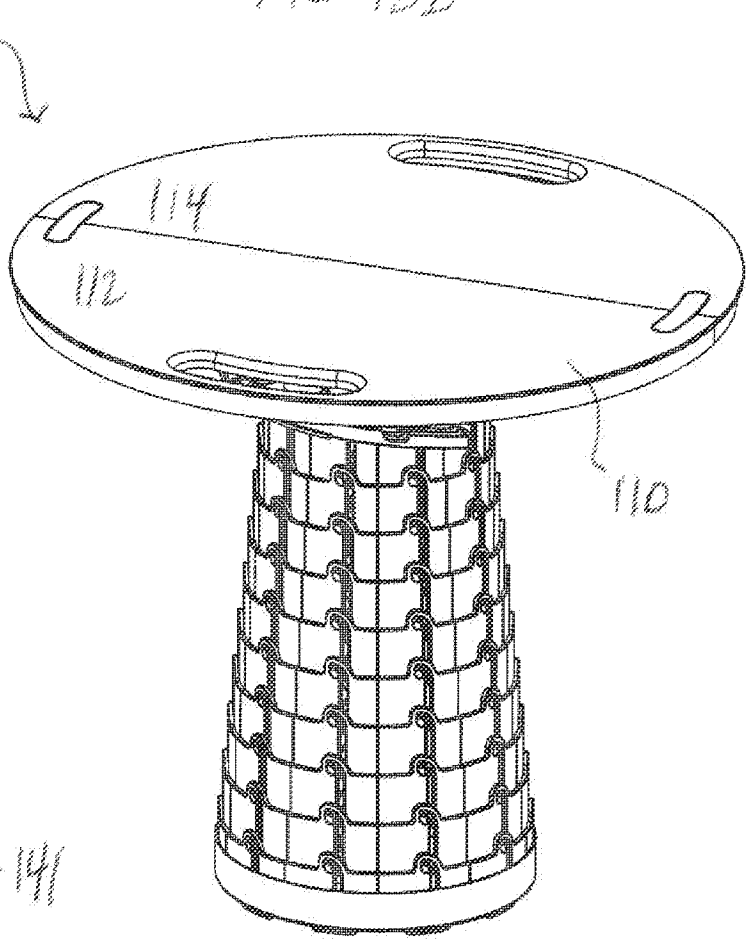
FIG. 12B is a perspective view of the table of FIG. 12A from a top and side angle, in accordance with an embodiment of the invention.
Figure 12A:
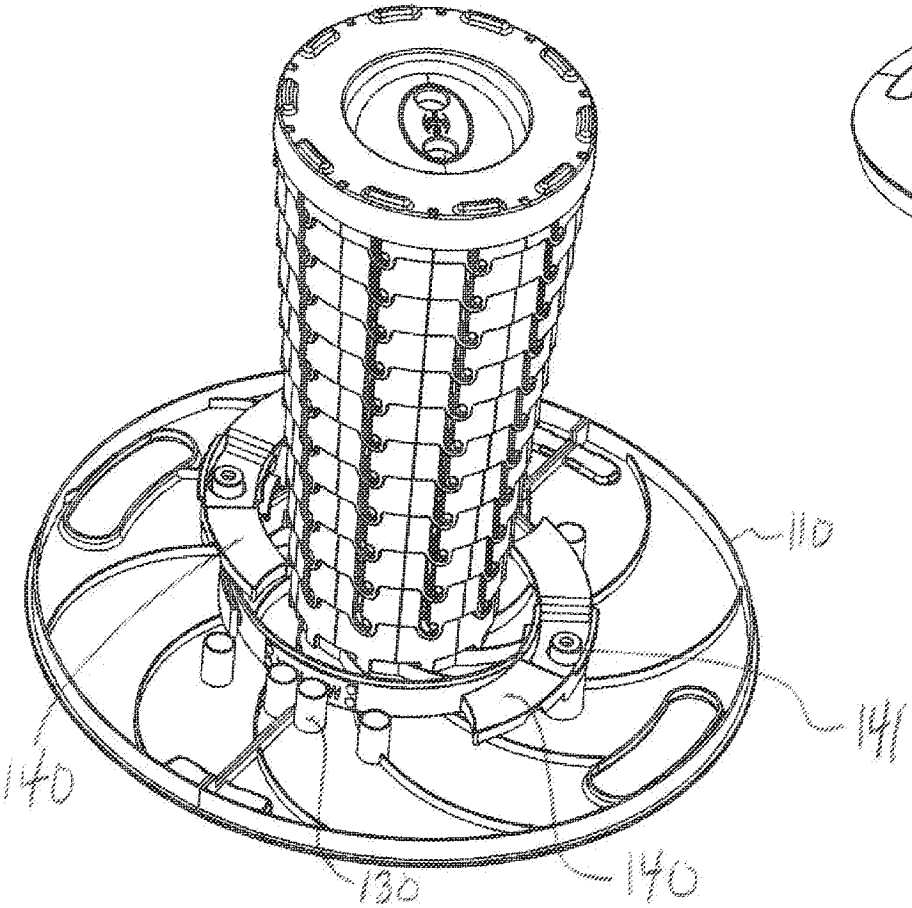
FIG. 12A is a perspective view of a table from a bottom and side angle, in accordance with an embodiment of the invention.

FIG. 11D shows another embodiment in which actuator 64 is connected to a lower end of cable 62 and rotation of actuator 64 twists cable 62 which shortens it and creates pressure on it to make cable 62 more rigid thereby activating security lock 60. Reverse rotation unlocks security lock 60.

It should be noted that security lock 60 is also a stabilizer that stabilizes the chair 10 in its fully retracted or partially retracted (partially deployed) position and prevents it from buckling or wobbling or collapsing.

FIG. 11A shows cable 62 when chair 10 is in a retracted position so that cable 62 fits in seat portion 20 of chair 10.

In the deployed position (FIG. 1, FIG. 10), rings 40 are locked with respect to one another thus consecutively extending a height of the foldable chair 10, while in the retracted position (FIG. 9) the rings 40 are unlocked and foldable towards a bottom surface of the seat portion 20.

Figure 8A:
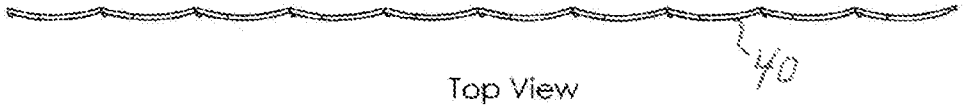
FIG. 8A is a top view of a ring of a foldable chair in a strip configuration, in accordance with one embodiment of the invention.
Figure 8B:
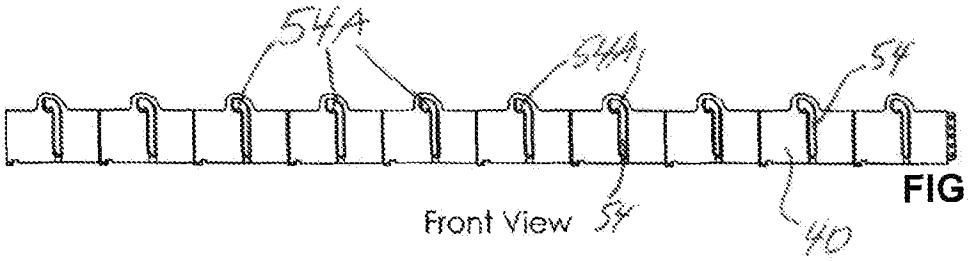
FIG. 8B is a front view of a ring of a foldable chair in a strip configuration, in accordance with one embodiment of the invention.
Figure 8C:
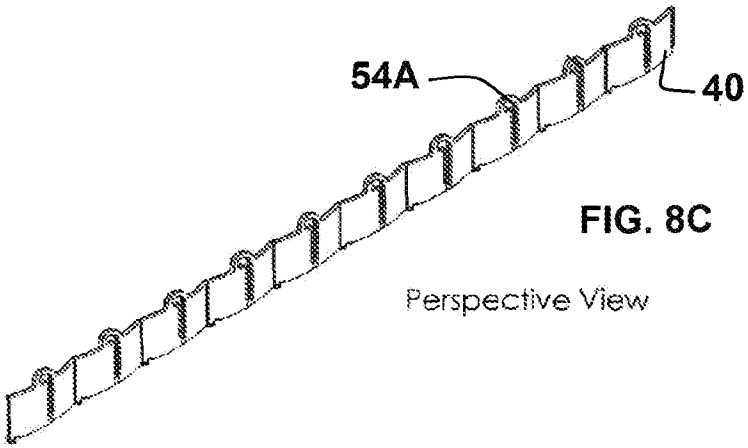
FIG. 8C is a perspective view of a ring of a foldable chair in a strip configuration, in accordance with one embodiment of the invention.
Figure 8D:
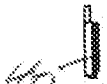
FIG. 8D is a side view of a ring of a foldable chair in a strip configuration, in accordance with one embodiment of the invention.
Figure 8E:
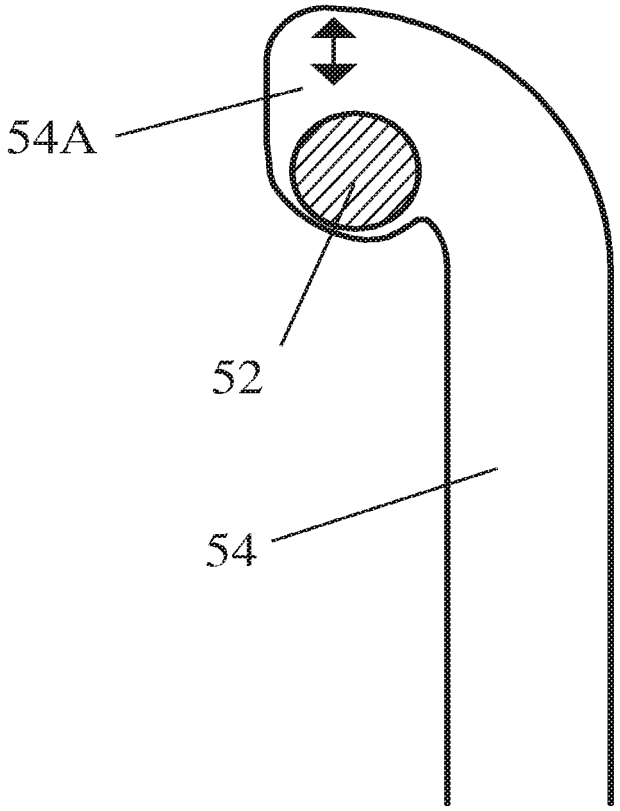
FIG. 8E is a schematic view of the pin and groove, in accordance with one embodiment of the invention.

In one embodiment, the locking arrangement 50 includes, for each ring 40 except uppermost ring 41, a pin 52 (see FIGS. 7A, 7B, 7C and 7D) and a groove 54 on each of the rings 40 such that the pin 52 fits with a corresponding groove 54 on an adjacent ring 40. This is true except for uppermost ring 41 which only has pins 52 but no grooves 54 since it is only adjacent the ring 40 below it. In some embodiments, as best seen in FIG. 8B and FIG. 8C, groove 54 extends along a height of the ring 40 and includes an arched segment 54A wherein the pin 52 of the adjacent ring 40 is configured to slide along the groove 54 and in and out of the arched segment 54A.

In some embodiments, as seen from FIG. 7A, FIG. 7B, FIG. 7C and FIG. 7D, the topmost ring 41 includes the pin 52 but no slot/groove 54.

The pin 52 may be disposed in the arched segments 54A such that the pin 52 locks two adjacent rings 40 to one another, and rotation of a first ring 40 sidewardly with respect to an adjacent ring causes the pin 52 to slide out of the arched segment 54A and unlocks the first ring 40 and wherein further sliding of the pin 52 along the groove 54 causes the first ring 40 to fold.

Figure 9A:
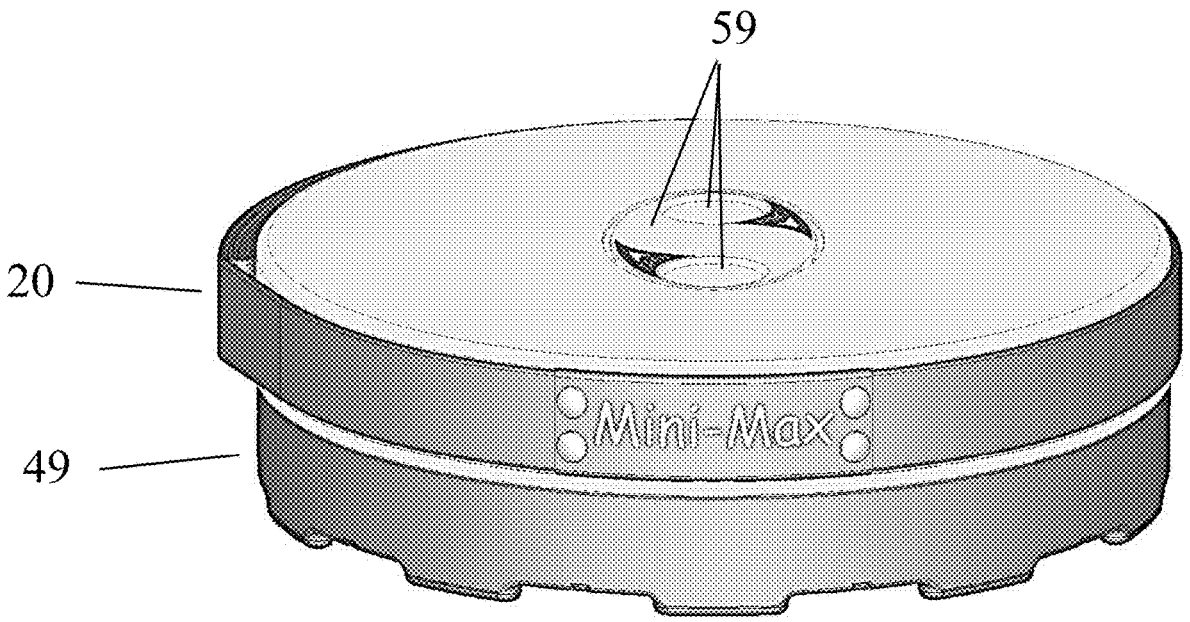
FIG. 9A is an isometric view of a foldable chair in fully retracted position and FIGS. 9B and 9C are isometric views of a foldable chair in fully retraced position with a handle, in accordance with one embodiment of the invention.
Figure 9C:
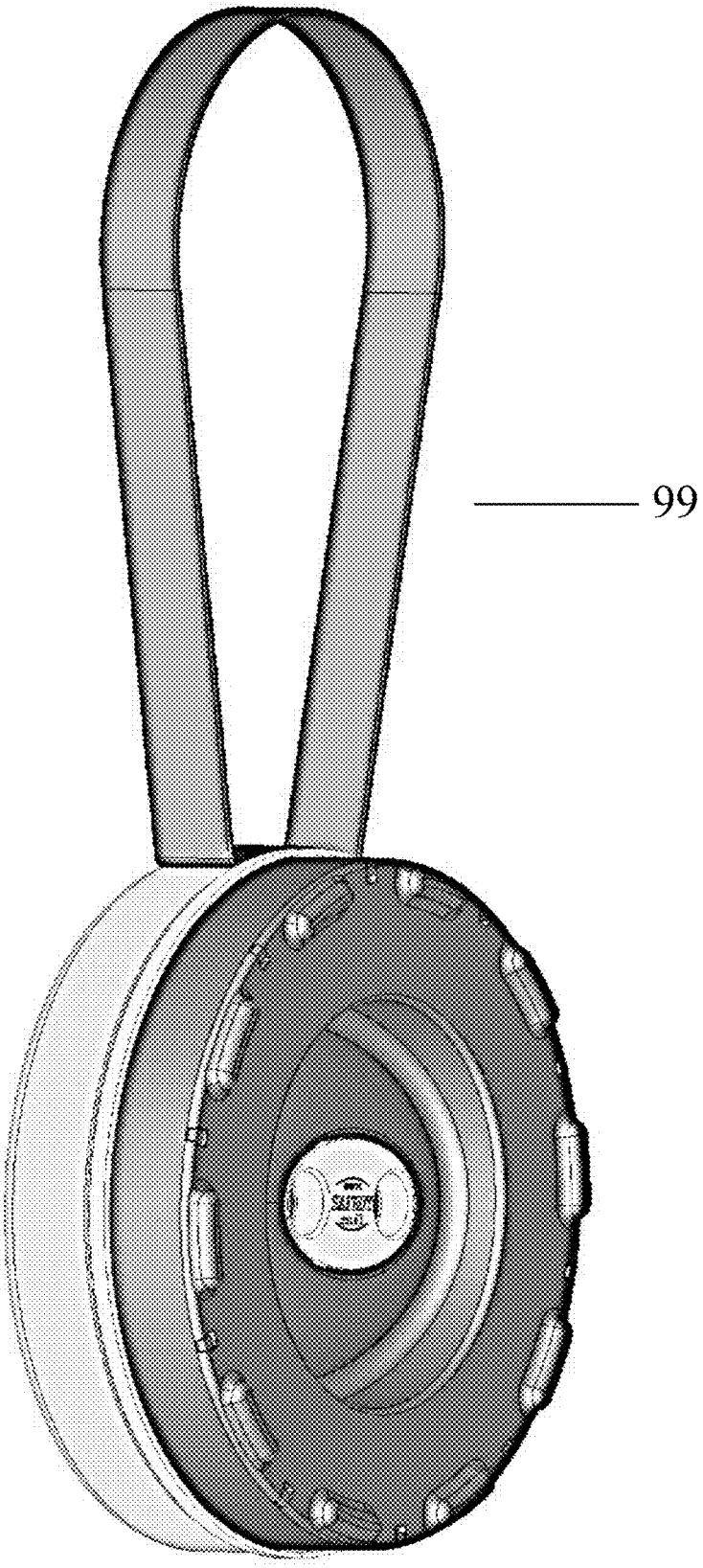
Figure 9B:
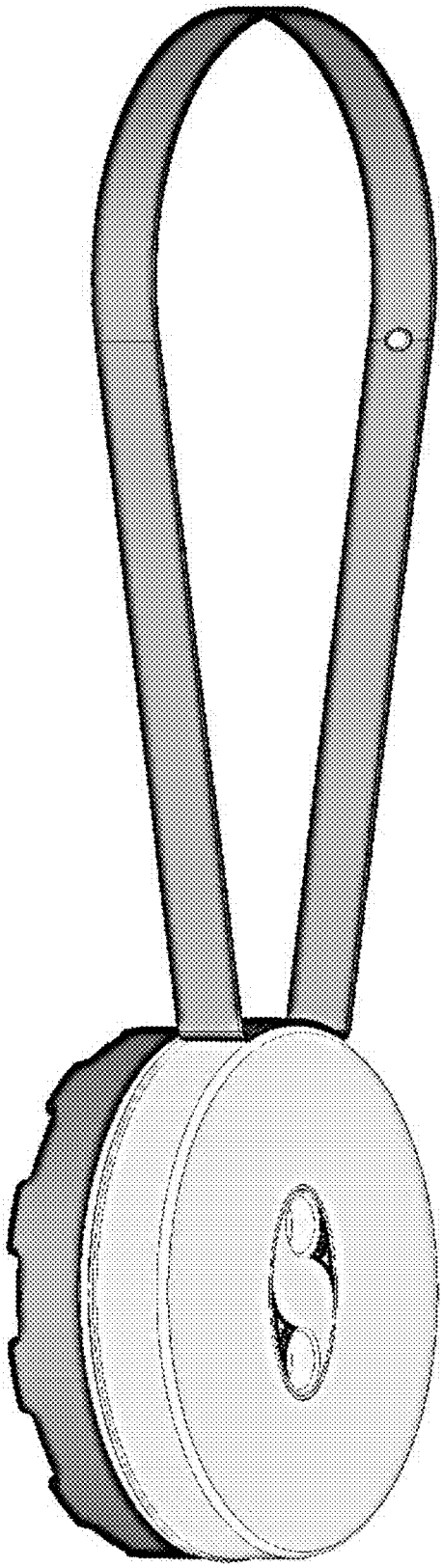
Figure 10:
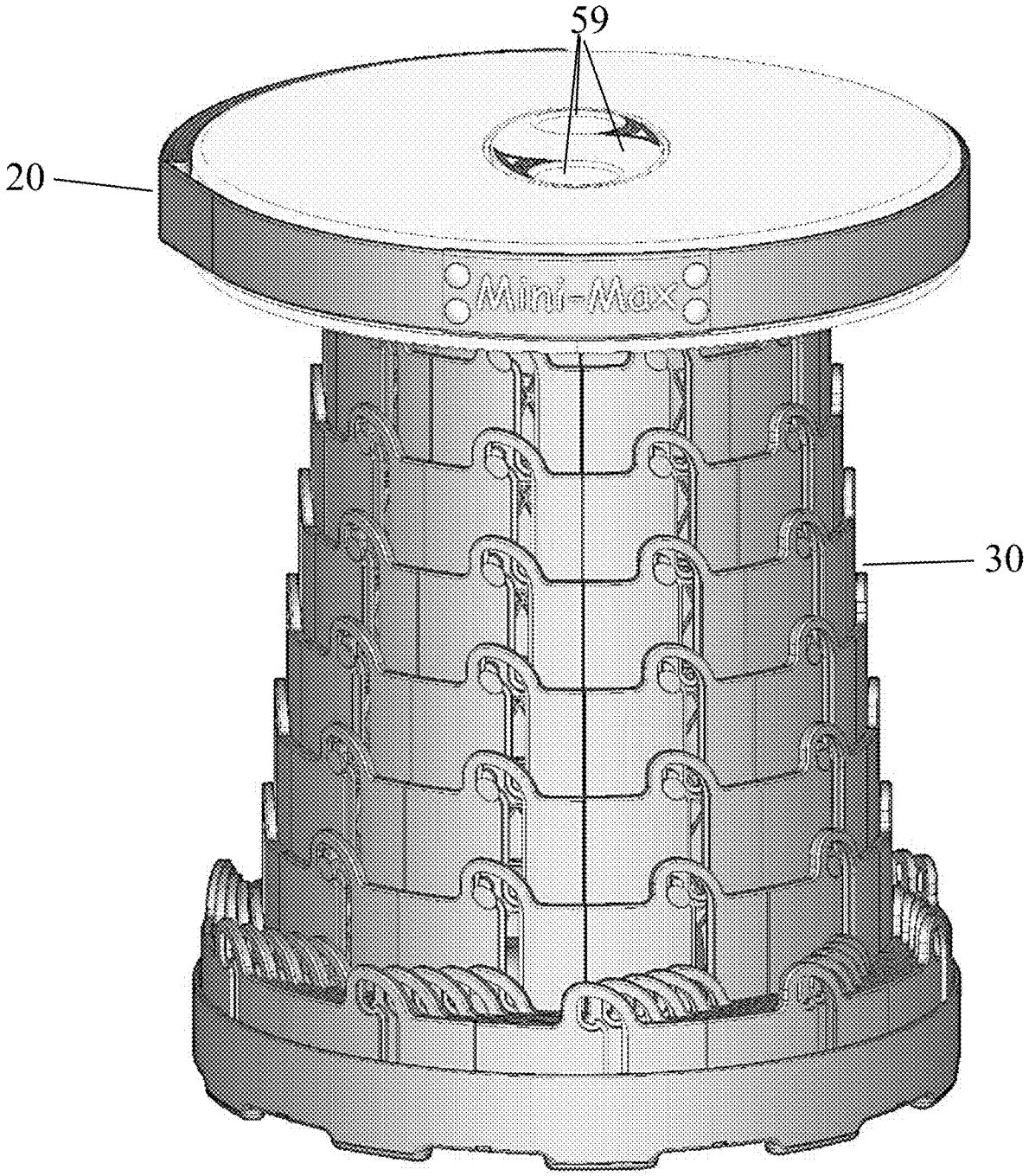
FIG. 10 is a perspective view of a foldable chair in deployed position, in accordance with an embodiment of the invention.

As seen in FIG. 9 and FIG. 10, locking arrangement 50 may include an actuating mechanism 59 for rotating the rings 40 with respect to one another and thereby releasing the locking arrangement 50. In one non-limiting example, the actuating mechanism 59 comprises or includes a rotation disk 59 on a top surface of the seat portion 20 coupled to a topmost ring 41 such that a pulling and rotation motion of the rotation disk 59 rotates the rings 40 to release the locking arrangement. As shown in FIG. 59, chair 10 may also include an integrated carrying strap 99.

In another embodiment of the invention shown in FIG. 12A, FIG. 12B, FIG. 13, FIG. 14, FIG. 16 and FIG. 17, the invention is a foldable table 100 having a deployed table position and having a table storage position. Foldable table 100 comprises (A) a leg portion 10 comprising a foldable chair 10 either positioned centrally as a leg of the foldable table 100 or positioned peripherally for storage on an underside of the table portion of the foldable table.

Each foldable chair 10 used either the leg portion 10 of table 100 or as a stored chair 10 may be any suitable version of the chair 10 already described above. In one non-limiting example, each foldable chair 10 may comprise a seat portion 20; a telescopic side wall 30 extending downwardly from the seat portion, the telescopic side wall including a plurality of rings of varying diameters and consecutively arranged such that a topmost ring 41 is mounted to a bottom surface of the seat portion 20 and has a smallest diameter and a bottom-most ring 49 has a largest diameter, the telescopic side wall 30 configured to have a deployed position that is completely opened or partially folded such that a desired height of the chair 10 is set and locked, and a retracted position such that in a fully retracted position all of the rings 40 are disposed adjacent the bottom surface of the seat portion, wherein each of the rings is an integral unit having a height and configured with a locking arrangement that selectively locks each ring with respect to an adjacent ring 40; and a security lock 60 centrally disposed along a height of the foldable chair 10 substantially perpendicular to the varying diameters of the rings 40, the security lock 60 configured to secure the locking arrangement.

The foldable table 100 may further comprise a table portion 110 foldable on itself into two segments and having an underside with at least one central pin 120 for receiving in the deployed table position the seat portion of the foldable chair in the deployed position of the foldable chair 10. In one non-limiting implementation shown in FIG. 12A, and further shown in FIG. 17, table portion 110 has two central pins 120 one on an underside of each segment 112, 114 of table portion 110 (which together comprises an underside of table portion 110) as well as a two pairs of peripheral pins 130 (called "peripheral" because these pins are more peripherally situated than the central pin(s) 120) to receive a first fully retracted chair 10 and a second fully retracted chair 10.

Figure 13:
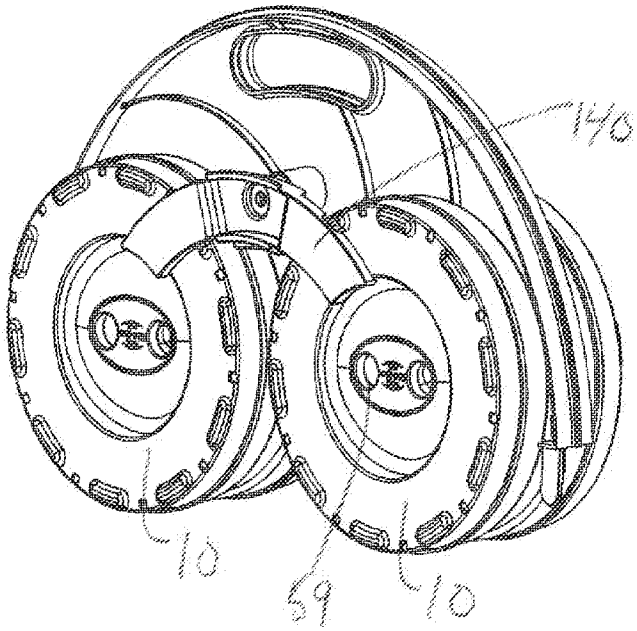
FIG. 13 is a perspective view showing the table portion of the table of FIG. 12A-FIG. 12B folded holding three stored chairs, in accordance with an embodiment of the invention.
Figure 15:
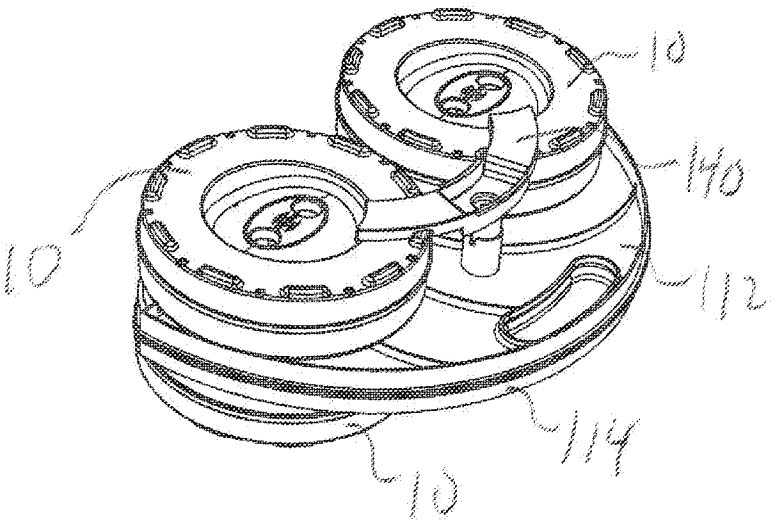
FIG. 15 is a perspective view of a table portion of a table folded and holding three stored chairs in locked position, in accordance with an embodiment of the invention.
Figure 16:
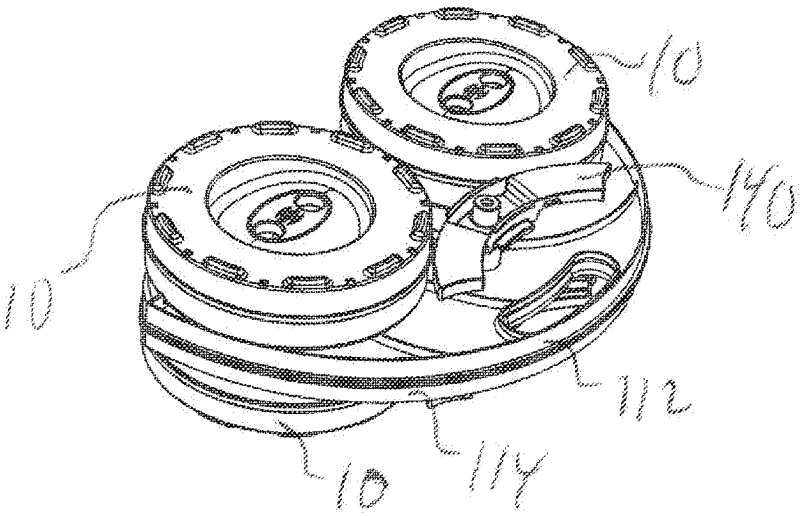
FIG. 16 is a perspective view of a table portion of a table folded and holding three stored chairs in unlocked position, in accordance with an embodiment of the invention.
Figure 17:
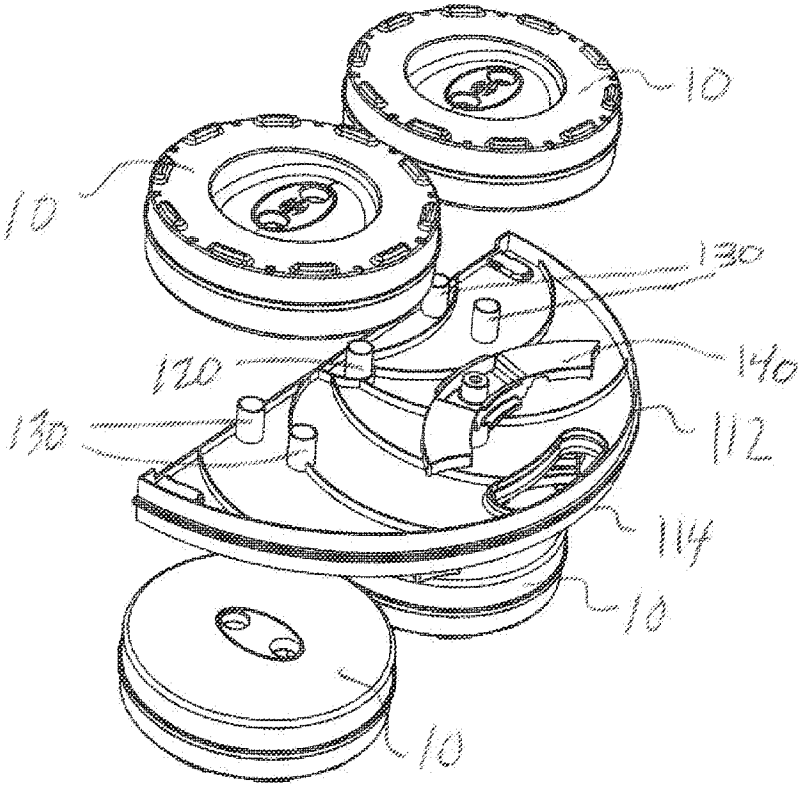
FIG. 17 is an exploded perspective view of a table portion of a table folded and four chairs for storage, in accordance with an embodiment of the invention.

The central pins 120 and the peripheral pins 130 have attached thereto a stabilizing lock 140 controlled by a spring and rotatable to secure the deployed chair functioning as the leg portion or to secure the retracted chair 10 being stored by table 100. In one implementation seen in FIG. 12A, stabilizing lock 140 has an arcuate rotatable portion that sits on central pin 120 and swivels against leg portion 10. Similarly, stabilizing lock 140 sits on peripheral pin(s) 130 and swivels from its position in FIG. 16 to block retracted chair 10, as seen in FIG. 13 and FIG. 15.

Figure 14:
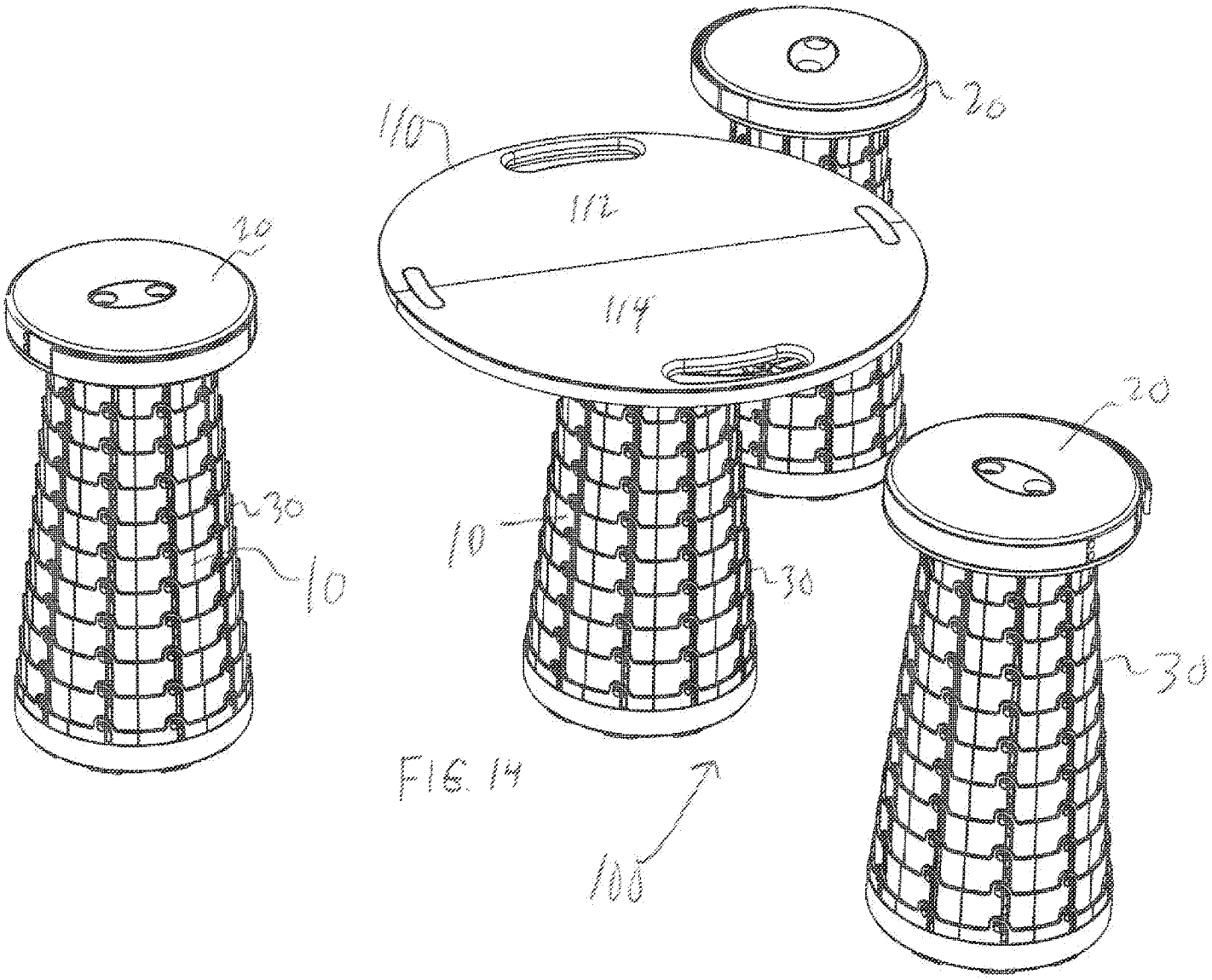
FIG. 14 is a perspective view of a table and three chairs, in accordance with an embodiment of the invention.

FIG. 14 shows chair 10 functioning as the leg portion 10 of table 100 and also depicts three chairs 10 that can be used for persons to sit around the table 100. When the users are finished using the chairs and the table 100, these three chairs and the fourth chair that is shown as the leg portion of table 100 can also be stored on the underside of table 100 before or after table portion 110 is folded into two segments 112, 114.

Accordingly, in some embodiments, the underside of table portion 110 also has at least one central pin 120 for receiving, in the table storage position, the seat portion of at least one foldable chair. In some embodiments, table 100 includes a stabilizing lock 140 controlled by a spring (within spring housing 141) and rotatable to secure the leg portion.

In some embodiments, an underside of each of the two segments 112, 114 also has at least one pin, for example at least one peripheral pin, for receiving, in the table storage position, the seat portion of at least one foldable chair 10. In some embodiments, table 100 also has a further stabilizing lock 140 controlled by a spring and rotatable to secure the at least foldable chair in the table storage position. In one version, the underside of each of the two segments 112, 114 also has at least one pin, for example at least one peripheral pin 130 for receiving, in the table storage position, the seat portion of at least one foldable chair 10. An underside of each of the two segments may have two pairs of pins including each pair of pins for receiving, in the table storage position, the seat portions of each of two foldable chairs.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A foldable chair, comprising:

a seat portion;

a telescopic side wall extending downwardly from the seat portion, the telescopic side wall including a plurality of rings of varying diameters and consecutively arranged such that a topmost ring is mounted to a bottom surface of the seat portion and has a smallest diameter and a bottommost ring has a largest diameter, the telescopic side wall configured to have a deployed position that is completely opened or partially folded such that a desired height of the chair is set and locked, and a retracted position such that in a fully retracted position all of the rings are disposed adjacent the bottom surface of the seat portion, wherein each of the rings is an integral unit configured with a locking arrangement that selectively locks each ring with respect to an adjacent ring; and a security lock centrally disposed along a height of the foldable chair substantially perpendicular to the varying diameters of the rings, the security lock configured to secure the locking arrangement.

2. The foldable chair of claim 1, wherein the security lock comprises a flexible cable centrally disposed within a spring through the height of the foldable chair and connecting the seat portion with the bottommost ring in both the deployed and retracted positions, the bottommost ring having an actuator accessible to a user, so that a user who actuates the actuator releases the security lock by releasing pressure on the flexible cable.

3. The foldable chair of claim 2, wherein the actuator is configured to either move a coupler that tenses the flexible cable or the actuator twists the flexible cable.

4. The foldable chair of claim 1, wherein in the deployed position the rings are locked with respect to one another thus consecutively extending the height of the foldable chair, while in the retracted position the rings are unlocked and foldable towards a bottom surface of the chair portion.

5. The foldable chair of claim 1, wherein the locking arrangement includes, for each ring except an uppermost ring, a pin and a groove on each of the rings such that the pin fits with a corresponding groove on an adjacent ring.

6. The foldable chair of claim 5, wherein the groove extends along a height of the ring and includes an arched segment wherein the pin of the adjacent ring is configured to slide along the groove and in and out of the arched segment.

7. The foldable chair of claim 5, wherein a topmost ring includes the pin but no slot.

8. The foldable chair of claim 5, wherein when the pin is disposed in the arched segments the pin locks two adjacent rings to one another, rotation of a first ring sidewardly with respect to an adjacent ring causes the pin to slide out of the arched segment and unlocks the first ring and wherein further sliding of the pin along the groove causes the first ring to fold.

9. The foldable chair of claim 1, further comprising an actuating mechanism for rotating the rings with respect to one another and thereby releasing the locking arrangement, wherein the actuating mechanism includes a rotation disk on a top surface of the seat portion coupled to a topmost ring such that a lifting and rotation motion of the rotation disk rotates the rings to release the locking arrangement.

* * * * *